US005845573A

United States Patent [19]

Miyata

[11] Patent Number: 5,845,573

[45] Date of Patent: Dec. 8, 1998

[54] METHOD OF PRODUCING A PLANAR STAMP

[75] Inventor: Hiroyasu Miyata, Tokyo, Japan

[73] Assignees: Alps Electric Co., Ltd., Tokyo; Tetsuyuki Toyama, Aichi, both of Japan

[21] Appl. No.: 3,001

[22] Filed: Jan. 5, 1998

[51] Int. Cl.[6] ..... B41C 1/14; B41C 1/055; B41J 2/32

[52] U.S. Cl. ..... 101/128.4; 101/129; 101/333; 347/220; 347/221

[58] Field of Search ..... 101/128.4, 129, 101/333, 109, 112, 405; 347/220, 221

[56] References Cited

U.S. PATENT DOCUMENTS

| | | | |
|---|---|---|---|
| 5,205,214 | 4/1993 | Seo et al. | 101/333 |
| 5,582,105 | 12/1996 | Miki et al. | 101/128.4 |
| 5,669,299 | 9/1997 | Ando et al. | 101/128.4 |
| 5,741,459 | 4/1998 | Ando et al. | 264/293 |

FOREIGN PATENT DOCUMENTS

| | | |
|---|---|---|
| 07251558 A | 10/1995 | Japan . |
| 9-216447 | 8/1997 | Japan . |

*Primary Examiner*—Edgar Burr
*Assistant Examiner*—Daniel J. Colilla
*Attorney, Agent, or Firm*—Brinks Hofer Gilson & Lione

[57] ABSTRACT

A method of producing a planar stamp including a stamp member, an ink reservoir, and a stamp frame. In the method, after fitting the ink reservoir into the stamp frame, the stamp member, without a print surface and made of a polyethylene foam sheet, is adhered to the stamp frame in order to enclose it in the stamp frame, whereby a planar stamp portion is assembled. Then, a thermal head of a print surface forming apparatus is moved along an entire surface of the stamp member, while the thermal head is in contact with the stamp member, in order to form a print surface. Lastly, ink is injected into the ink reservoir in order to impregnate the stamp member with the ink.

7 Claims, 7 Drawing Sheets

METHOD OF PRODUCING A PLANAR STAMP

BACKGROUND OF THE INVENTION

1. Field of the Invention

The present invention broadly relates to a method of producing a planar stamp, and, more particularly, to a method of producing a penetration print type planar stamp capable of allowing repeated stamping without an inkpad.

2. Description of the Related Art

This type of planar stamp has been conventionally produced in the following way. After forming a print surface by pressing a thermoplastic resin foam sheet with continuous holes against a heated die, the sheet is cut into a predetermined size, forming a stamp member whose cut surface is thermally adhered to a stamp frame in order to prevent ink leaks. Thereafter, ink is injected to impregnate the stamp member with the ink.

A description will now be given in detail of a conventional method of producing a planar stamp, with reference to FIGS. 8A to 8D. In FIG. 8A, reference numeral 1 denotes a stamp member composed of a thermoplastic foam sheet with continuous holes, reference numeral 2 denotes a die heated by a heater 2*a*, and reference numeral 3 denotes a presser for pressing the stamp member against the die 2. As shown in FIG. 8B, when the stamp member 1 is pressed against the heated die 2 by means of the presser 3, the part of the foam sheet of the stamp member 1 which contacts a protrusion of the die 2 melts, causing the pores in this part to collapse, whereas the part of the foam sheet of the stamp member 1 which contacts a recess in the die 2 is not heated, causing the pores in this part to remain intact. These pores allow ink to seep therethrough, forming a print surface 1*a*.

The sheet-shaped stamp member 1 with the print surface 1*a* is cut to a size that can fit into a stamp frame 4, and, as shown in FIG. 8C, the cut stamp member 1 is fitted into the stamp frame 4 along with an ink reservoir 5. Thereafter, as shown in FIG. 8D, a cut surface 1*b* of the stamp member 1 is thermally welded to the stamp frame 4 to prevent ink leaks caused by the collapsing of the pores at the cut surface 1*b* of the stamp member 1 by heat. Then, ink is injected, thereby forming a planar stamp 6.

In recent years, Yamahachi Chemical Co., Ltd. has introduced a polyethylene foam sheet, which has allowed a print surface to be formed easily and quickly using a thermal head connected to a storage processor, such as a personal computer, so that this method can be used to form a print surface, instead of the print surface forming method performed using a die and requiring a platemaking step. An example of a stamp print surface forming method using a thermal head is disclosed in Japanese Unexamined Patent Publication No. 7-251558. In this method, a print surface of a planar stamp is formed by feeding, under compression, a resilient resin sheet, having continuous pores and capable of being impregnated with ink, between the thermal head and a platen.

All of these prior arts relate to methods of forming a print surface of a thermoplastic resin foam sheet with continuous pores. However, in these methods, the print surface is formed before assembling the planar stamp.

However, a great variety of print surfaces are needed to respond to the demands of customers. In recent years, it is becoming necessary to respond to the demand of customers wanting to create their own original print surfaces that do not exist anywhere else in the world. Although the conventional methods, using a die, are suitable for mass-producing stamps with identical print surfaces, they cannot easily satisfy the demands of every customer, and are costly to perform, since they require various types of dies. On the other hand, the methods of forming a print surface, using a thermal head, instead of a die, do not allow easy production control, since various surfaces of stamps must be produced together, and cannot be performed at a low cost.

SUMMARY OF THE INVENTION

Accordingly, in order to overcome the above-described problems, it is an object of the present invention to provide a method of producing penetration print type planar stamp capable of satisfactorily responding to the demands of customers wanting to create various print surfaces, facilitating production control, and allowing production at a low cost.

To this end, according to the present invention, there is provided a method of producing a penetration print type planar stamp including a stamp member with a print surface, an ink reservoir for holding ink, and a stamp frame for holding the stamp member and the ink reservoir, the method comprising the steps of assembling a planar stamp portion, after fitting the ink reservoir into the stamp frame, by adhering the stamp member without the print surface to the stamp frame to enclose it in the frame, the stamp member being a thermoplastic resin foam member having continuous holes; forming the print surface by moving a thermal head of a print surface forming apparatus along an entire surface of the stamp member, while the thermal head is in contact with the stamp member; and injecting ink into the ink reservoir to impregnate the stamp member with the ink.

According to the present invention, considering the entire production process of a planar stamp, instead of forming a print surface for a stamp member after assembling the stamp member, as has been the case in the conventional methods, the print surface forming step and an ink injecting step are performed, after assembling a planar stamp portion, at the end of the stamp production process. This allows the print surface forming step and the ink injecting step to be performed, for example, in stamp shops or by the customer, himself, so that it is possible to provide planar stamps with various print surfaces at a low cost, and to respond to various demands of customers. This is because the planar stamp portions prior to formation of a print surface are common portions, which differ only in size and shape, making it possible to mass-produce planar stamp portions in factories, and freely allowing print surfaces to be produced in shops or by the customer, using a print surface forming apparatus connected to a storage processor, such as a personal computer or a word processor.

An example of a material which may be used for the stamp member, to which a print surface may be formed with a thermal head, is the polyethylene foam sheet manufactured by Yamahachi Chemical Co., Ltd. The polyethylene foam sheet is adhered to a stamp frame to enclose it in the stamp frame. Here, when a cut surface of the stamp member is affixed to the stamp frame by thermal welding, the pores of the cut surface of the stamp member collapse, preventing ink leaks from the cut surface of the stamp member.

When forming a print surface using a thermal head after assembling a planar stamp portion, it is important to ensure stable contact between a surface of the stamp member and an end of the thermal head. One way to achieve stable contact is to form an outwardly-projecting wall on the stamp frame, with the lower surface of the wall being formed as a reference surface that is parallel to the surface of the stamp member, and forming a reference surface for a head supporting member of a print surface forming apparatus that is parallel to the end of the thermal head. During formation of the print surface, the end of the thermal head moves along the entire surface of the stamp member, while it is in contact therewith, such that the reference surfaces of the stamp frame and the head supporting member slide past each other.

The print surface forming apparatus may be constructed such that a head holding member, holding the thermal head, and the head supporting member, supporting the head holding member, can move relative to each other in a vertical direction with respect to the surface of the stamp member. By virtue of such a construction, the thermal head has mechanical freedom in the vertical direction with respect to the surface of the stamp member, and can, by pressing against the stamp member, stably contact the surface of the stamp member.

A resin film, which is thermally resistant to and has a small frictional resistance with respect to the thermal head, may be interposed between the thermal head and the stamp member in order to form the print surface. The interposition of the resin film reduces shifting of the print surface caused by pulling of the surface of the stamp member partly melted by the heat produced by the thermal head, allowing formation of a higher quality print surface.

BRIEF DESCRIPTION OF THE DRAWINGS

FIGS. 8A to 8D are each sectional views showing an arrangement of parts in a conventional producing method, wherein FIG. 8A shows the arrangement prior to the formation of the print surface, FIG. 8B shows the arrangement during formation of the print surface, FIG. 8C shows the arrangement in which the stamp material is fitted into the stamp frame, and FIG. 8D shows the condition in which the stamp material is affixed to the stamp frame.

DESCRIPTION OF THE PREFERRED EMBODIMENTS

A description will now be given of a first embodiment in accordance with the present invention, with specific reference to FIGS. 1 to 4.

Figure 1:
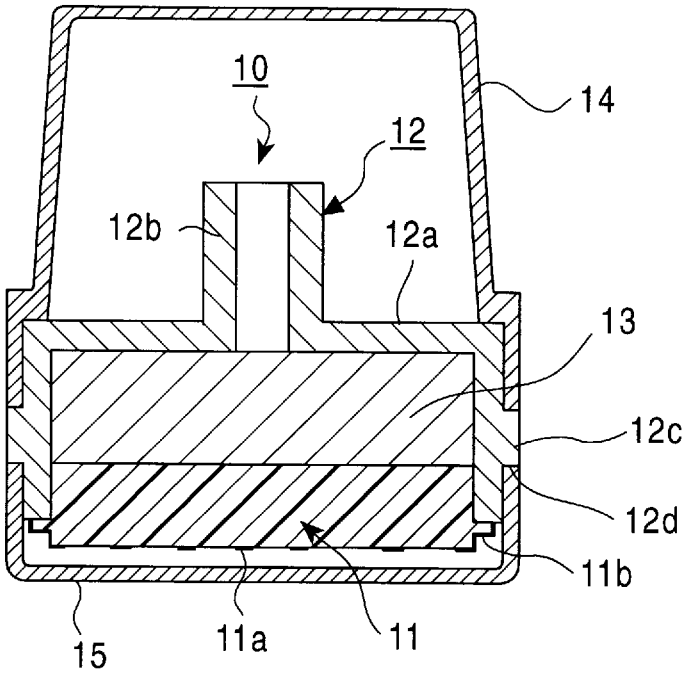
FIG. 1 is a sectional view of a planar stamp completed by a producing method of a first embodiment in accordance with the present invention.
Figure 2:
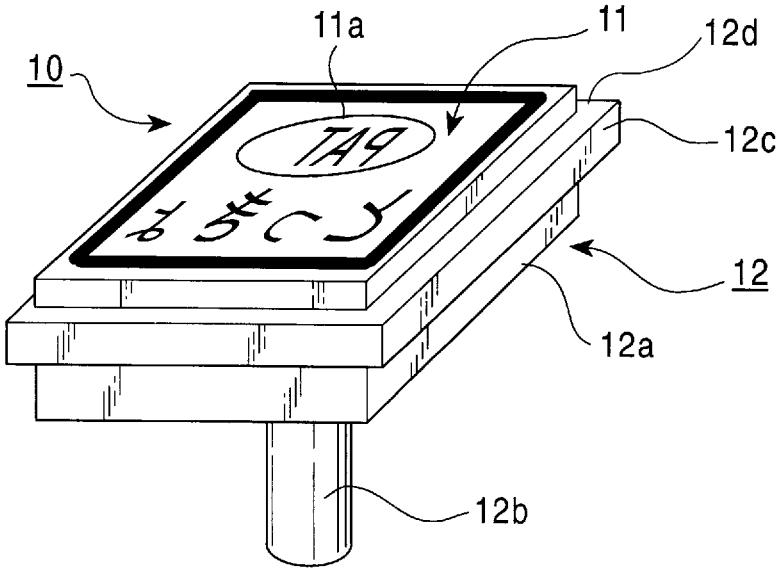
FIG. 2 is a perspective view of FIG. 1.

FIG. 1 is a sectional view of a completed planar stamp 10. FIG. 2 is perspective view of FIG. 1. In the figures, reference numeral 11 denotes a stamp member, reference numeral 12 denotes a stamp frame, and reference numeral 13 denotes an ink reservoir.

As shown in FIGS. 1 and 2, the stamp frame 12 has a rectangular, box-shaped body 12*a* and a cylindrical knob 12*b* projecting upward from the body 12*a* and serving as an ink injecting opening. The ink reservoir 13 is fitted into the stamp frame 12, and the stamp member 11, with a print surface 11*a*, is affixed at its cut surface 11*b* to the stamp frame 12. The ink reservoir 13 holds ink and serves to keep the planar surface of the stamp member 11 in a planar form. The stamp frame 12 has a wall 12*c* projecting outwardly from the stamp frame 12, with the lower surface of the wall 12*c* serving as a reference surface 12*d* that is parallel to the surface of the stamp member 11. Reference numerals 14 and 15 denote, respectively, a cover and a cap, both of which are used when accommodating the stamp 10.

For the stamp member 11, a polyethylene foam sheet (produced by Yamahachi Chemical Co., Ltd.), for example, may be used. For the ink reservoir 13, a member with a hole or a gap, ensuring impregnation of the stamp member 11 with the ink injected into the ink reservoir 13, may be used. An example of such a member is one having a hole, which is made of any plastic material, metal material, or the like.

A description will now be given of the method of producing the aforementioned planar stamp, with reference to FIGS. 3 and 4.

Figure 3:
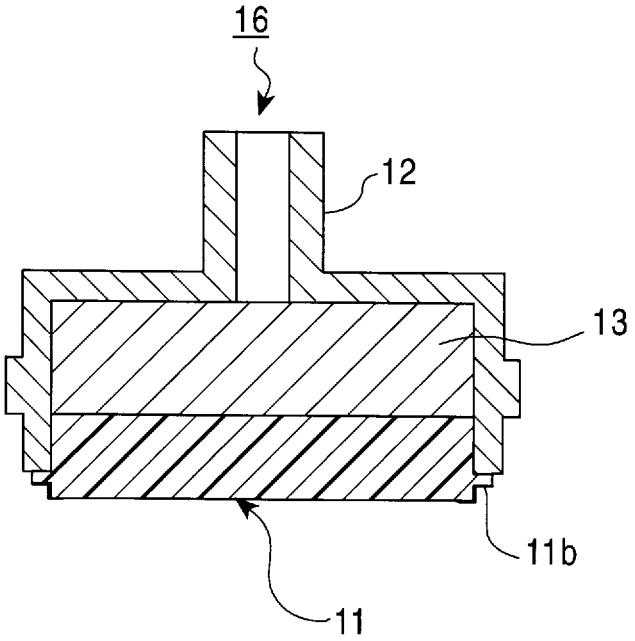
FIG. 3 is a sectional view of the planar stamp prior to the formation of a print surface, in the method of the same embodiment in accordance with the present invention.

As shown in FIG. 3, a planar stamp portion 16 is formed by fitting the ink reservoir 13 into the stamp frame 12, and then adhering the stamp member 11 without a print surface to the stamp frame 12, by thermal welding, for enclosing it in the stamp frame 12. Here, affixing the stamp member 11 to the stamp frame 12 by thermal welding causes the pores at the cut surface 11*b* of the stamp member 11 to collapse, thereby preventing ink leaks from the cut surface 11*b*.

Figure 4A:
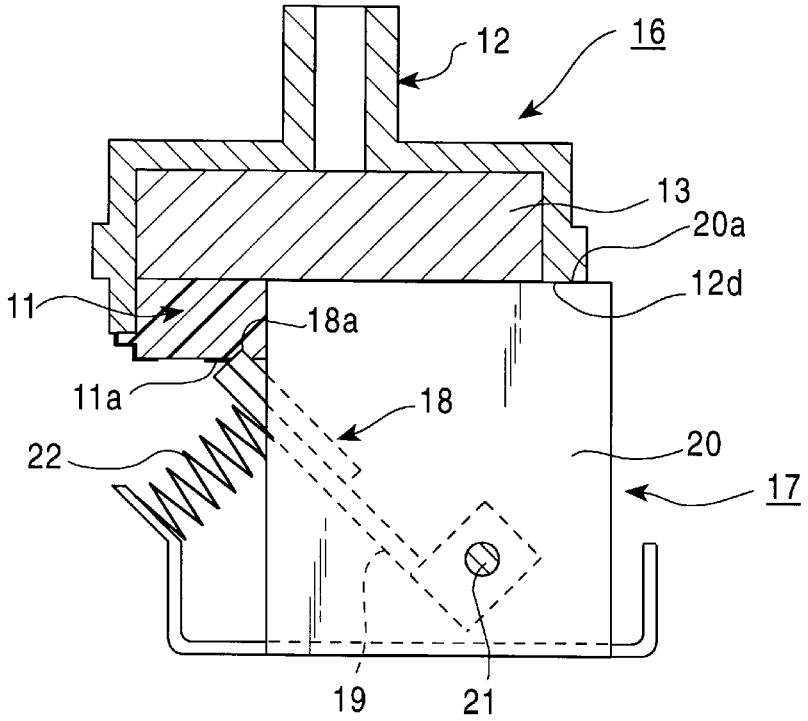
FIGS. 4A and 4B are a side sectional view and a front sectional view of a print surface forming apparatus and a planar stamp portion, during formation of the print surface, in the method of the same embodiment in accordance with the present invention.

As shown in FIG. 4A, in the print surface forming apparatus 17, a thermal head 18, having a heating resistor element (now shown) disposed at an end of a head substrate, is affixed to a head holding member 19 being rotatably supported on a shaft 21 affixed to a head supporting member 20. A spring 22, or the like, is connected to the head holding member 19 to cause the thermal head 18 to be pushed towards the stamp via the head holding member 19. The print surface forming apparatus 17 is used by connecting it to a storage processor, such as a personal computer or a word processor, having a desired character or pattern data input thereto to form the print surface.

Figure 4B:
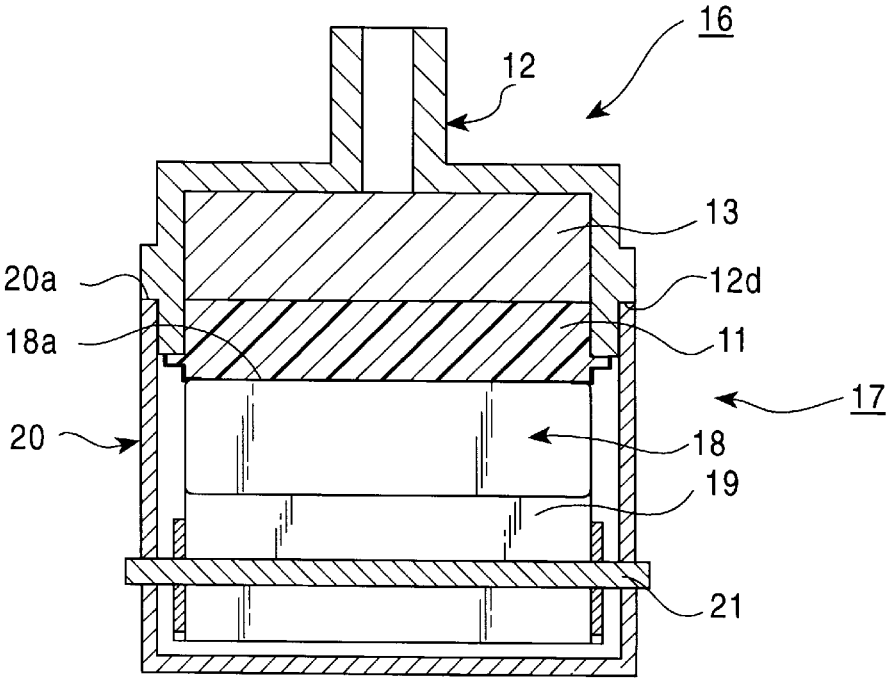

Then, using the above-described print surface forming apparatus 17, after completion of the planar stamp portion 16, the print surface 11*a* is formed on the stamp member 11. Here, as shown in FIGS. 4A and 4B, in the planar stamp portion 16, the entire thickness of the entire ink reservoir 13 is controlled so that it is uniform, with the reference surface 12*d* of the stamp frame 12 and the surface of the stamp member 11 set parallel to each other. On the other hand, in the print surface forming apparatus 17, the relative positions between an edge 18*a* of an end of the thermal head 18 and the reference surface 20*a* at the upper end of the head supporting member 20 are adjusted so that the edge 18*a* and the reference surface 20*a* are parallel to each other.

With the above-described control and adjustment operations performed, the reference surface 12*d* of the stamp frame 12 and the reference surface 20*a* of the head supporting member 20 are brought into contact. Sliding the planar stamp portion 16 along the print surface forming apparatus 17 such that their respective reference surfaces 12*d* and 20*a* slide past each other causes the edge 18*a* of the end of the thermal head 18 to move along the entire surface of the stamp member, while it is in contact therewith, thereby forming the print surface 11*a* based on the desired character or pattern data input in the storage processor. Thereafter, when the stamp member 11 is impregnated with ink injected into the ink reservoir 13, the planar stamp 10 is completed.

According to the method of producing a planar stamp of the present embodiment, it is possible to mass-produce the stamp portion 16 at a low cost in factories, since there are only a few types of stamp portions, which at most differ only in the size and shape of their print surfaces, and it is easy to assemble the step portion 16 before forming the print surface. In addition, since the print surface 11*a* is formed at the end of the stamp production process, by using only a generally-used storage processor (such as a personal computer or a word processor) and a print surface forming apparatus 17, the print surface 11*a* can be easily and freely formed, for example, in shops or by the customer, himself. Therefore, with this method, it is possible to satisfactorily respond to the demand for a method that allows formation of various print surfaces for different customers, facilitates production control in factories, and can be performed at a low cost.

When the stamp frame 12 and the print surface forming apparatus 17 have reference surfaces 12*d* and 20*a*, respectively, and the planar stamp portion 16 slides along the print surface forming apparatus 17 such that their respective reference surfaces slide past each other, the relative positions between the surface of the stamp member 11 and the edge 18*a* of the thermal head 18 can be maintained to ensure contact therebetween. Therefore, print surfaces can be stably formed.

Figure 5A:
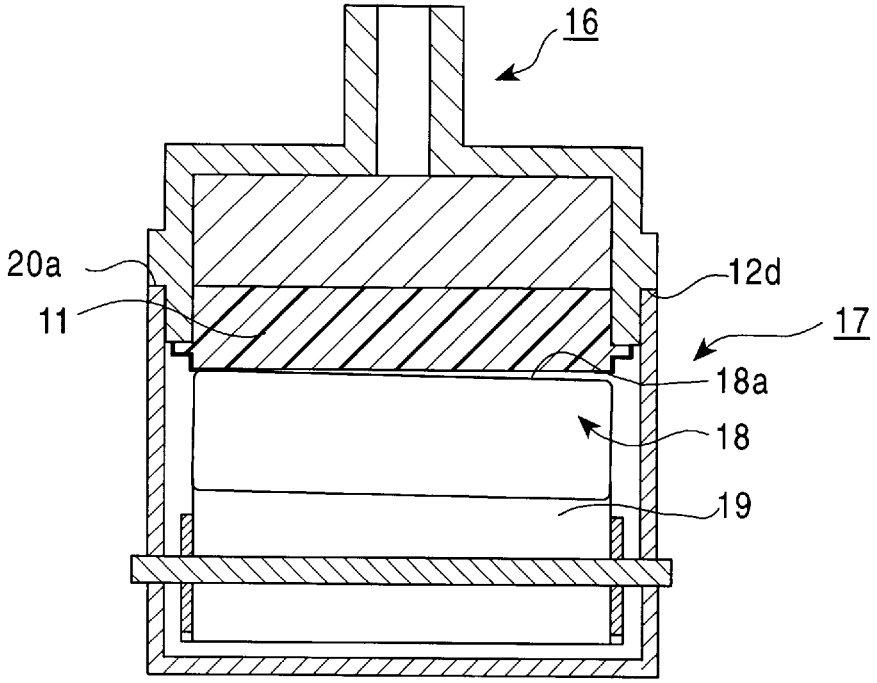
FIGS. 5A and 5B illustrate problems occurring during formation of the print surface.
Figure 5B:
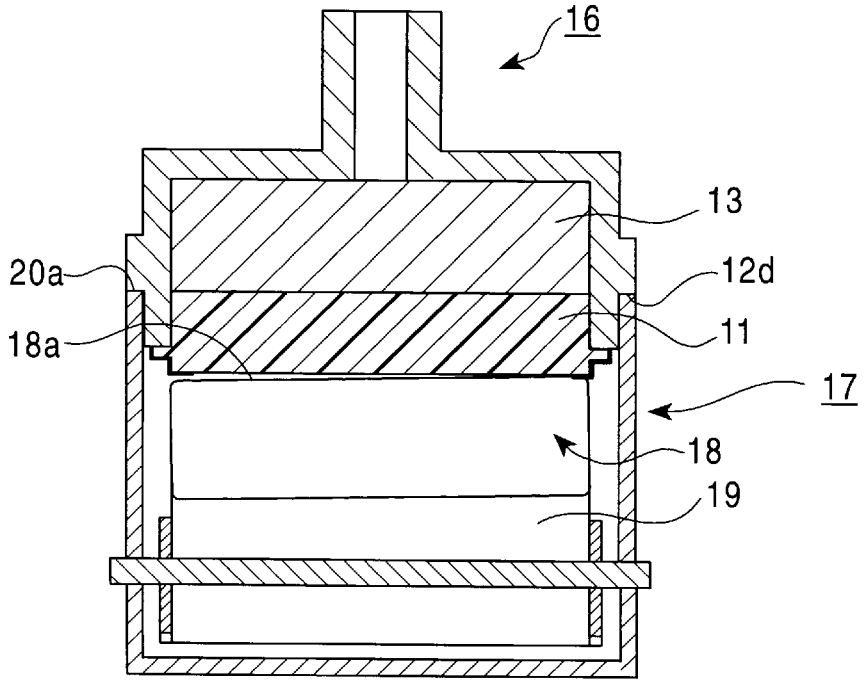

However, when, at the stamp side, the relative positions between the surface of the stamp member 11 and the reference surface 12*d* are not satisfactorily controlled, or when, at the print surface forming apparatus side, the relative positions between the edge 18*a* of the thermal head and the reference surface 20*a* are not satisfactorily controlled, a gap may be formed between the thermal head 18 and the stamp member 11, as shown in FIGS. 5A and 5B, preventing reliable formation of print surfaces. In addition, the stamp member 11, which is a resilient member, limits the extent to which the relative positions between the surface of the stamp member 11 and the stamp reference surface 12*d* can be controlled, so that, here again, a gap may be produced therebetween. These problems can be overcome in the following way.

A description will now be given of a second embodiment in accordance with the present invention, with reference to FIG. 6.

In the method of producing a planar stamp of the present embodiment, the structure and method of assembling the planar stamp portion are exactly the same as those used in the producing method of the first embodiment. It differs from the method of the first embodiment in that a print surface forming apparatus with a different structure is used. Therefore, the common portions will not be described. Only the print surface forming apparatus with the different structure will be described.

Figure 6A:
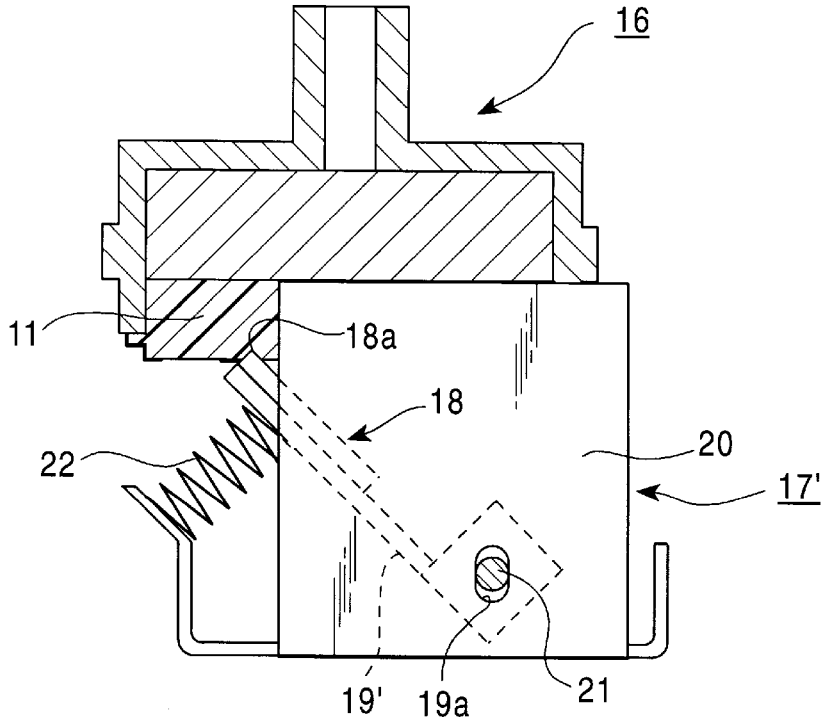
FIGS. 6A and 6B are a side sectional view and a front sectional view of a print surface forming apparatus and a planar stamp portion, in a producing method of a second embodiment in accordance with the present invention.
Figure 6B:
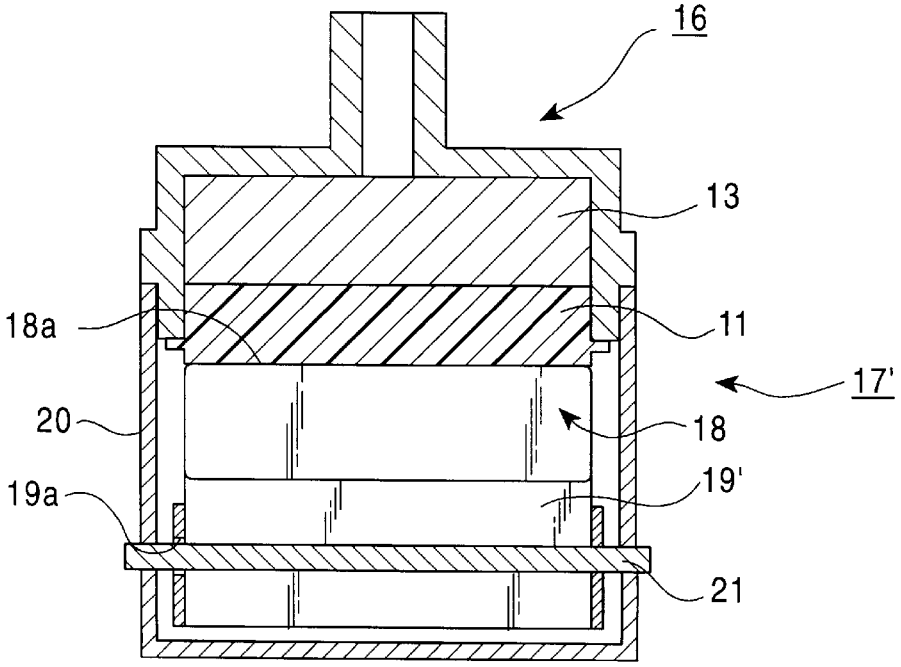

As shown in FIGS. 6A and 6B, in the print surface forming apparatus 17' of the present embodiment, one of the holes, hole 19*a*, in a head holding member 19', through which a shaft 21 affixed to a head supporting member 20 extends, is formed into the shape of a slot that is long in a vertical direction with respect to a surface of a stamp member 11. Therefore, the position of the head holding member 19', and thus the position of an edge 18*a* of a thermal head 18, are not completely fixed, so that the head holding member 19' and the thermal head 18*a* have mechanical freedom in the vertical direction with respect to the surface of the stamp member 11.

Therefore, when the print surface forming apparatus 17' having the above-described construction is used, the thermal head 18, which presses against the stamp member 11, moves in accordance with the flatness of the stamp member 11, thereby ensuring line contact of the thermal head 18 with the stamp member 11 and thus allowing stable formation of the print surface. In addition, since the slot 19*a* in the head holding member 19' is long in the vertical direction with respect to the surface of the stamp member 11, the thermal head 18 has a small mechanical freedom in the direction of movement of the thermal head 18 along the entire surface of the stamp member 11, and a large mechanical freedom in the vertical direction with respect to the surface of the stamp member 11. Consequently, it is possible to stably form a print surface by achieving more reliable line contact between the thermal head 18 and the entire surface of the stamp member 11.

Although, in the present embodiment, only one of the two holes in the head holding member 19', or the hole 19*a*, was formed into the shape of a slot, both of the holes may be slot-shaped to obtain similar effects. The structure, in which the head holding member and the head supporting member can move relative to each other in a vertical direction with respect to the surface of the stamp member, is not limited to one having slot-shaped holes formed in the head supporting member.

Figure 7:
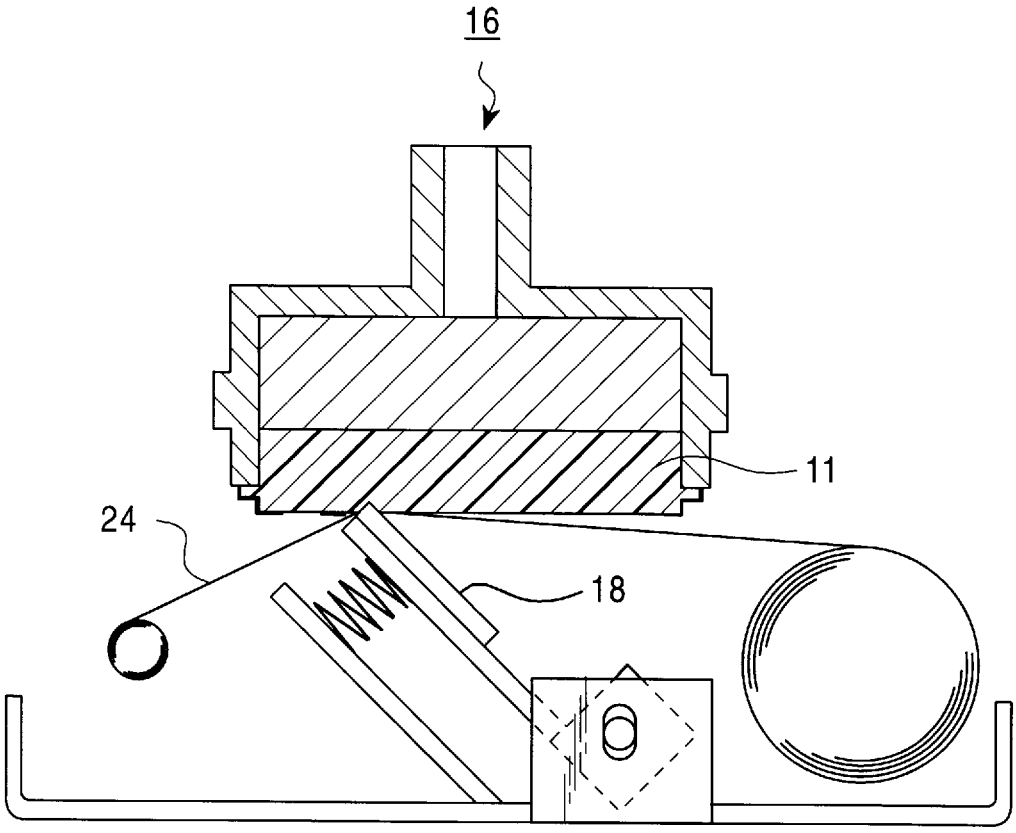
FIG. 7 is a side sectional view showing a print surface forming apparatus and a planar stamp portion, during formation of the print surface, in a producing method of a third embodiment in accordance with the present invention.
Figure 8A:
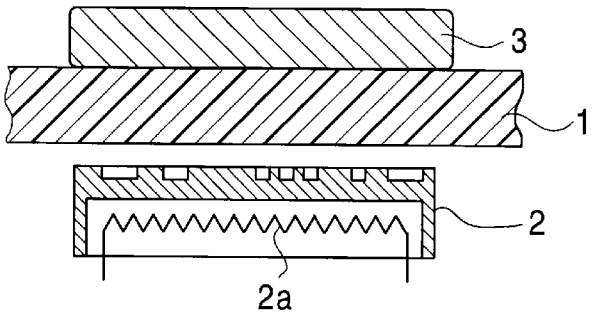
FIG. 8A PRIOR ART
Figure 8B:
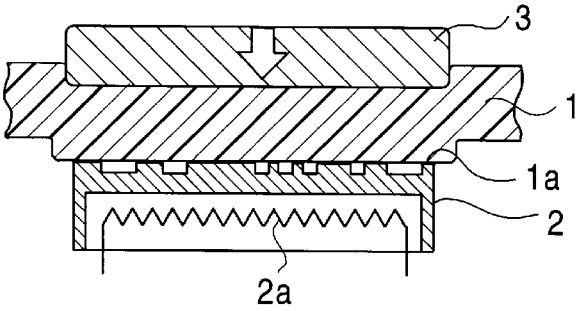
FIG. 8B PRIOR ART
Figure 8C:
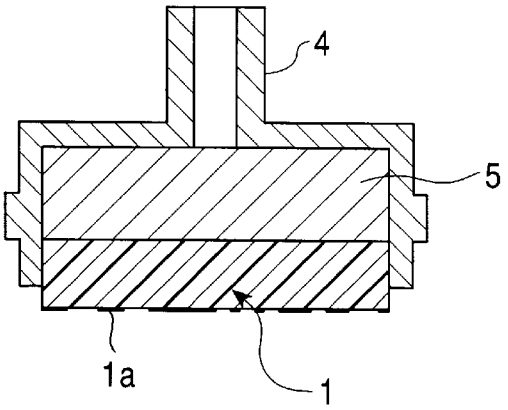
FIG. 8C PRIOR ART
Figure 8D:
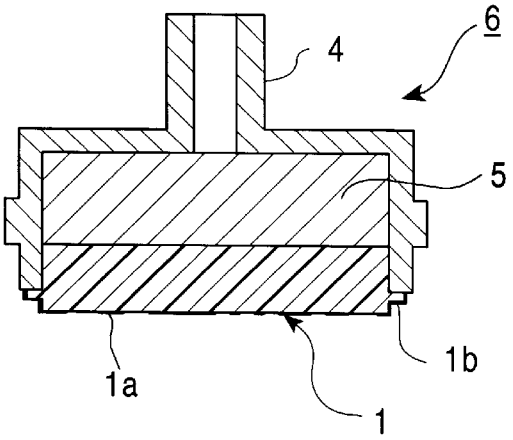
FIG. 8D PRIOR ART

A description will now be given of a third embodiment in accordance with the present invention, with reference to FIG. 7.

In the method of producing a planar stamp in the present embodiment, the structure and assembly method of the planar stamp portion used are exactly the same as those used in the first embodiment. The method of the third embodiment differs only in the method of forming the print surface. Therefore, only the method of forming the print surface will be described below.

When the portion of the surface of a thermoplastic resinous stamp member contacts the portion of the thermal head heated by a heating resistor element, this portion melts, suddenly increasing the frictional resistance thereof. The resin partly melted by the movement of the head gets pulled, which may prevent a very precise print surface from being formed. To overcome this problem according to the present embodiment, as shown in FIG. 7, a thin polyimide film 24 (or a resinous film) is interposed between the stamp member 11 and the thermal head 18. The polyimide film 24 is highly resistant to the heat produced by the thermal head 18, has low frictional resistance with respect to the thermal head 18, and is thin since it only needs to be formed to a thickness of, for example, about 7 $\mu$m, which is capable of maintaining the shape of the end of the thermal head 18.

In the present embodiment, the polyimide film 24, interposed between the stamp member 11 and the thermal head 18, prevents a pulling force from being exerted onto the partly melted resin, thereby making it possible to reduce shifting of the print surface caused by exertion of a pulling force on the melted resinous surface, whereby a print surface with a very high quality can be produced.

In the foregoing description, the formation of the print surface by the thermal head of the print surface forming apparatus was not described in detail. This is because it can be easily understood that an energization pulse applied to a heating resistor element of the thermal head, and a drive pulse generated for mechanically sliding the thermal head or the planar stamp portion can be controlled as they are in a conventional printer with a thermal head, in order to similarly print a desired character or a pattern to form a stamp print surface.

The technical scope of the present invention is not limited to the above-described embodiments, so that various modifications may be made without departing from the spirit of the present invention. For example, any material, shape, or dimension may be used for the stamp member, the ink reservoir, the stamp frame, or any other component part. In addition, any structure other than those of the above-described embodiments may be used for the print surface forming apparatus.

As described in detail above, according to the method of producing a planar stamp of the present invention, the stamp member can be adhered to the stamp frame in order to assemble and form a planar stamp portion as a commercial product, without forming the print surface and injecting ink. Only a simple assembly step needs to be performed up to the time of formation of the planar stamp portion into a commercial product, allowing the planar stamp portion to be mass-produced. In addition, since there are only a few types of planar stamp portions, the stamp portions are very well suited for mass production and can be supplied at a low cost. Further, since the print surface can be easily formed with a thermal head subsequent to the formation of the planar stamp portion into a commercial product, printer techniques similar to those utilized by, for example, a personal computer printer, a word processor printer, a label printer, or a postcard printer, may be used to freely form a character or a pattern, using a thermal head, so that a cheap print surface forming apparatus can be realized. Consequently, it is possible to realize a print surface forming apparatus for use in a stamp shop or by an individual, as well as a stamp automatic vending machine for automatically making a stamp, in which the customer selects a pattern and inputs a name to automatically create a stamp.

Forming the print surface so as to meet the various demands of the customers at the end of the stamp producing process is highly effective in making possible new forms of business. Since the ink injecting step is the last step, so that an individual can inject colored ink of his choice, the stamp producing method is capable of responding to the demands of an individual even further. With the same specification, more effective mass production to decrease costs and satisfactory response to various preferences and demands of customers, or the like, are realized separately, making it possible to realize a cheap, high-quality penetrating-type planar stamp capable of satisfying every customer. The realization of such a planar stamp has made it possible to move one step further towards idealizing the way in which stamps are produced, and is effective in opening up new stamp businesses.

What is claimed is:

1. A method of producing a penetration print type planar stamp including a stamp member with a print surface, an ink reservoir for holding ink, and a stamp frame for holding the stamp member and the ink reservoir, said method comprising the steps of:

assembling a planar stamp portion, after fitting the ink reservoir into the stamp frame, by adhering the stamp member without the print surface to the stamp frame for enclosing said stamp member in said stamp frame, the stamp member being a thermoplastic resin foam member having continuous holes;

forming the print surface by moving a thermal head of a print surface forming apparatus along an entire surface of the stamp member, while the thermal head is in contact with the stamp member; and injecting ink into the ink reservoir to impregnate the stamp member with the ink.

2. A method of producing a planar stamp according to claim 1, wherein said print surface forming step further comprises the step of:

providing an outwardly-projecting wall on the stamp frame, forming the lower surface of the wall as a reference surface that is parallel to a surface of the stamp member, and forming a reference surface on a head supporting member of the print surface forming apparatus, the reference surface being parallel to an end of the thermal head;

wherein the end of the thermal head is moved along the entire surface of the stamp member, while the end of the thermal head is in contact with the stamp member, such that the reference surfaces of the stamp frame and the head supporting member slide past each other.

3. A method of producing a planar stamp according to claim 2, wherein said method is performed by a print surface forming apparatus allowing a head holding member for holding the thermal head holding member for supporting the head holding member for holding the thermal head and a holding member for supporting the head holding stamp member.

4. A method of producing a planar stamp according to claim 2, wherein said print surface forming step further comprises the step of interposing a resin film, being thermally resistant to and having a small frictional resistance with respect to the thermal head, between the thermal head and the stamp member.

5. A method of producing a planar stamp according to claim 1, wherein said method is performed by a print surface forming apparatus allowing a head holding member for holding the thermal head and the head supporting member for supporting the head holding member to move relative to each other in a vertical direction with respect to a surface of the stamp member.

6. A method of producing a planar stamp according to claim 5, wherein said print surface forming step further comprises the step of interposing a resin film, being thermally resistant to and having a small frictional resistance with respect to the thermal head, between the thermal head and the stamp member.

7. A method of producing a planar stamp according to claim 1, wherein said print surface forming step further comprises the step of interposing a resin film, being thermally resistant to and having a small frictional resistance with respect to the thermal head, between the thermal head and the stamp member.

* * * * *

UNITED STATES PATENT AND TRADEMARK OFFICE

CERTIFICATE OF CORRECTION

PATENT NO. : 5,845,573

DATED : December 8, 1998

INVENTOR(S) : Hiroyasu Miyata

It is certified that error appears in the above-indentified patent and that said Letters Patent is hereby corrected as shown below:

In claim 3, starting on line 4, change "holding member for supporting the head holding member for holding the thermal head and a holding member for supporting the head holding" to --and the head supporting member for supporting the head holding member to move relative to each other in a vertical direction with respect to a surface of the--.

In claim 5, line 4, change "the head supporting member" to --a holding member--.

Signed and Sealed this

Twenty-eighth Day of September, 1999

*Attest:*

Q. TODD DICKINSON

*Attesting Officer*

*Acting Commissioner of Patents and Trademarks*